US007328636B2

(12) United States Patent
Camacho

(10) Patent No.: US 7,328,636 B2
(45) Date of Patent: Feb. 12, 2008

(54) HEX WRENCH DEVICE

(76) Inventor: Cecelia Camacho, 500 Wall St. #1306, Seattle, WA (US) 98121

( * ) Notice: Subject to any disclaimer, the term of this patent is extended or adjusted under 35 U.S.C. 154(b) by 0 days.

(21) Appl. No.: 11/627,324

(22) Filed: Jan. 25, 2007

(65) Prior Publication Data

US 2007/0199413 A1 Aug. 30, 2007

Related U.S. Application Data

(60) Provisional application No. 60/761,837, filed on Jan. 25, 2006.

(51) Int. Cl.
*B25B 23/00* (2006.01)
*B25B 33/00* (2006.01)

(52) U.S. Cl. ..... 81/439; 81/436

(58) Field of Classification Search ..... 81/439, 81/436, 185, 180.1
See application file for complete search history.

(56) References Cited

U.S. PATENT DOCUMENTS

| | | | | |
|---|---|---|---|---|
| 3,127,798 | A * | 4/1964 | Gol | 81/439 |
| 3,651,720 | A * | 3/1972 | Indyk | 81/124.5 |
| 4,384,499 | A | 5/1983 | Shockley | |
| 4,663,998 | A | 5/1987 | Parsons et al. | |
| 5,386,749 | A * | 2/1995 | Kim | 81/185 |
| 6,467,379 | B1 | 10/2002 | Wizman | |
| 6,701,809 | B2 | 3/2004 | Huang | |
| 6,732,615 | B2 * | 5/2004 | Layaou | 81/124.5 |

* cited by examiner

*Primary Examiner*—David B Thomas
(74) *Attorney, Agent, or Firm*—Victor N. King; Speckman Law Group PLLC

(57) ABSTRACT

A hex wrench device, comprising at least one longitudinal member and at least one pair of complementary wrench sleeves which can be magnetically and longitudinally connected to the longitudinal member, wherein a hex key having a larger total surface area than that of the longitudinal member is formed when the complementary wrench sleeves are magnetically and longitudinally connected to the longitudinal member.

20 Claims, 1 Drawing Sheet

HEX WRENCH DEVICE

CROSS REFERENCE TO RELATED APPLICATION

This application claims priority under 35 U.S.C. § 119(e) to U.S. Provisional Patent Application No. 60/761,837, filed Jan. 25, 2006.

FIELD OF INVENTION

This invention generally relates to a hex wrench device, and particularly, this invention relates to a magnetic hex wrench device.

BACKGROUND OF THE INVENTION

A hex wrench, Allen wrench, or key wrench, is a tool known in the art having a hexagonal head used to turn or drive screws, bolts, and the like having hexagonally shaped receiving sockets. In general, the head of a hex wrench has six contact surfaces that can be inserted into a screw or a bolt's hexagonally shaped socket. In operation, torque is applied to the hex wrench to turn the screw or the bolt.

U.S. Pat. No. 4,384,499 discloses a tool set having a carrier unit for holding a plurality of tool units, such as various-sized Allen wrenches. Movement of the tool unit relative to the carrier allows alternative positioning of the tool in two working positions and storage position.

U.S. Pat. No. 4,663,998 discloses a socket for a socket wrench set, having a magnet in the bottom thereof. The magnet serves to hold a bolt head fitted in the socket, as well as to secure the socket to a wrench longitudinal member that is inserted in the bottom hole of the socket.

U.S. Pat. No. 6,467,379 discloses an adjustable socket for engaging various sized fastener projections such as hexagonal nuts. The adjustable socket includes a socket body with a cavity having a spring-biased plate pushing nested and concentrically positioned sliding sleeves toward the socket opening and their first position. Magnetic strip pairs integrated between the sleeves form magnetic couples when the sleeves are in the first position. Adjustment of the socket to an appropriate size is effected by the intrusion of a nut, which will encounter one or more of the smaller sleeves and shear the magnetic coupling between the largest of the smaller sleeve and the next largest sleeve.

U.S. Pat. No. 6,701,809 discloses an elastic socket wrench connector device. The connector device is magnetized in order to attract a bolt to the socket wrench. The length of the device can be adjusted to fit different kinds of socket wrenches and sockets.

Tool devices having a plurality of wrenches held by a carrier are also known in the art. However, the configuration of such devices can cause wear and tear to the individual wrenches due to prolonged contact of the individual wrenches with each other. Additionally, when one individual wrench is in use, the remaining wrenches can interfere with proper use of the wrench in use by reducing the amount of rotational clearance of the tool device relative to a screw or a bolt. Further, the remaining wrenches can also interfere with proper and comfortable grasping of the tool device when one wrench is being used.

Thus, it is desirable to provide a device to overcome the aforementioned disadvantages and problems.

SUMMARY OF THE INVENTION

A hex wrench device comprising at least one longitudinal member and a plurality of complementary wrench sleeves pairs is provided. The inventive hex wrench device is capable of forming a series of hex keys with incrementally increasing surface areas by way of magnetic force. Adjustment of a particular hex key to a desired size entails either magnetically attaching or magnetically disassembling the appropriate wrench sleeves to or from the longitudinal member.

In one embodiment, the longitudinal member, resembling any hex wrench known in the art, comprises a head with a hexagonal configuration, or having six sides, at an operational end of the longitudinal member. The body of the longitudinal member comprises six longitudinal surfaces and each longitudinal surface corresponds to one side of the hexagonally shaped head. The longitudinal member's body is further provided with at least one aperture located proximal to the non-operational end of the longitudinal member.

Each wrench sleeve of the plurality of complementary wrench sleeves pairs has at least one longitudinal surface. In one embodiment, the first wrench sleeve of a pair of complementary wrench sleeves has one longitudinal surface and the second wrench sleeve of the pair has five longitudinal surfaces. In another embodiment, the first wrench sleeve of a pair of complementary wrench sleeves has two longitudinal surfaces and the second wrench sleeve of the pair has four longitudinal surfaces. In yet another embodiment, the first wrench sleeve of a pair of complementary wrench sleeves has three longitudinal surfaces and the second wrench sleeve of the pair also has three longitudinal surfaces. When assembled, the interior of each longitudinal surface of a complementary pair of wrench sleeves is magnetically and longitudinally connected to the body of the longitudinal member to form a hex key. Further, each wrench sleeve is provided with at least one aperture located proximal to the non-operational ends of wrench sleeve.

In one embodiment of the hex wrench device, the longitudinal member provides a magnetic force and the plurality of wrench sleeves is made of a material having a high permeability, which is the degree of magnetization of a material that responds linearly to an applied magnetic field. In this embodiment, the longitudinal member is constructed of a material capable of providing magnetic force or comprises at least one magnet or an electromagnet located in the interior of its body, substantially extending along the length of the longitudinal member's body, and the wrench sleeves are made of iron or steel. In another embodiment, the longitudinal member comprises a plurality of magnets or electromagnets located in the interior of its body.

In another embodiment of the hex wrench device, the longitudinal member is not a magnet and is not provided with a magnet or an electromagnet. Rather, the longitudinal member is made of iron or steel and the plurality of wrench sleeves comprises at least one magnet or made of materials capable of providing magnetic force.

The hex wrench device is further provided with a carrier that movably holds the longitudinal member and the plurality of wrench sleeves. The carrier resembles a key ring and may have various configurations including, but not limited to, circular, oval, triangular, quadrilateral, hexagonal, and the like. The carrier passes through the aperture of longitudinal member and the apertures of the wrench sleeves. The carrier is sized to fit through the apertures of the longitudinal member and the plurality of wrench sleeves, so that the longitudinal member and the wrench sleeves can slide freely around the carrier.

In operation, the longitudinal member functions as a hex key and constitutes the smallest-sized hex key of the hex wrench device. The complementary wrench sleeve pairs are capable of forming a series of hex keys with incrementally increasing surface areas when the complementary wrench sleeve pairs are assembled. For example, when two wrench sleeves of a first complementary wrench sleeve pair are magnetically and longitudinally connected to the longitudinal member, a hex key having a larger surface area than that of the longitudinal member is formed. When two wrench sleeves of a second complementary wrench sleeve pair, having a larger total surface area than that of the first complementary wrench sleeve pair, are magnetically and longitudinally connected to the first complementary wrench sleeve pair, which in turn is magnetically and longitudinally connected to the longitudinal member, another hex key having a larger surface area than that of the magnetically and longitudinally connected first complementary wrench sleeve pair and longitudinal member is formed.

BRIEF DESCRIPTION OF THE DRAWINGS

The present invention will be described in greater detail in the following detailed description, with reference to the accompanying drawings, wherein.

DETAILED DESCRIPTION OF THE INVENTION

Figure 1:
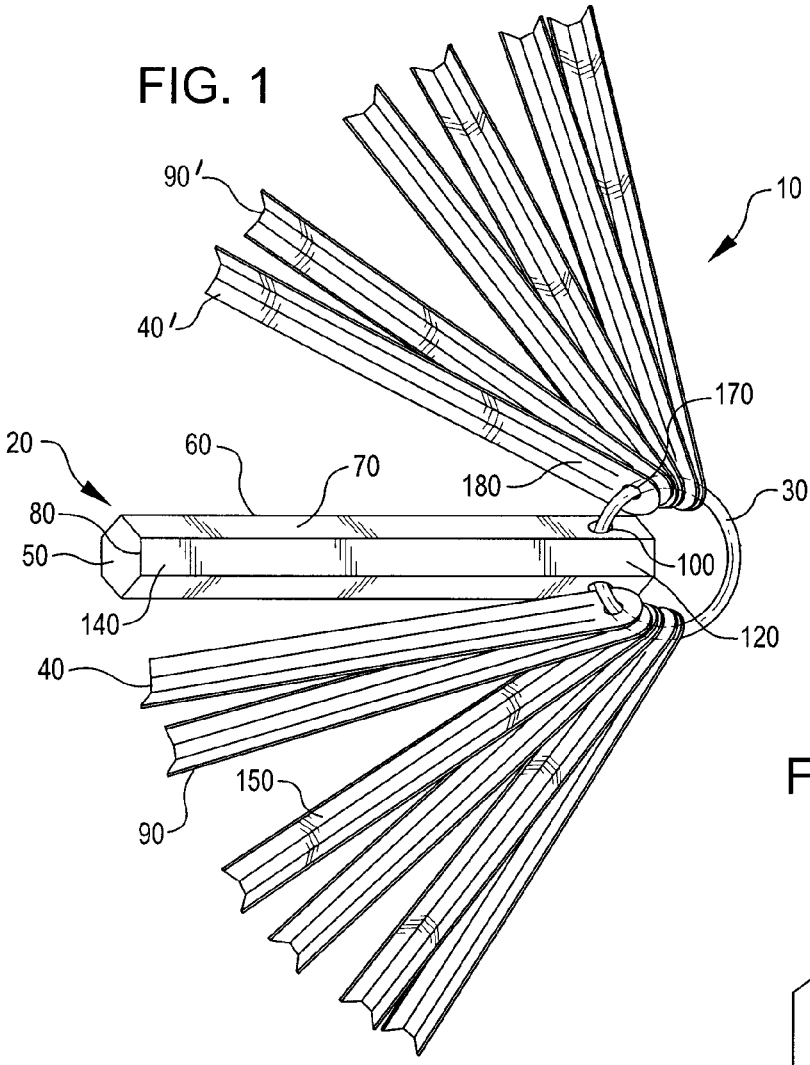
FIG. 1 shows a perspective view of an embodiment of an unassembled hex wrench device.
Figure 2:
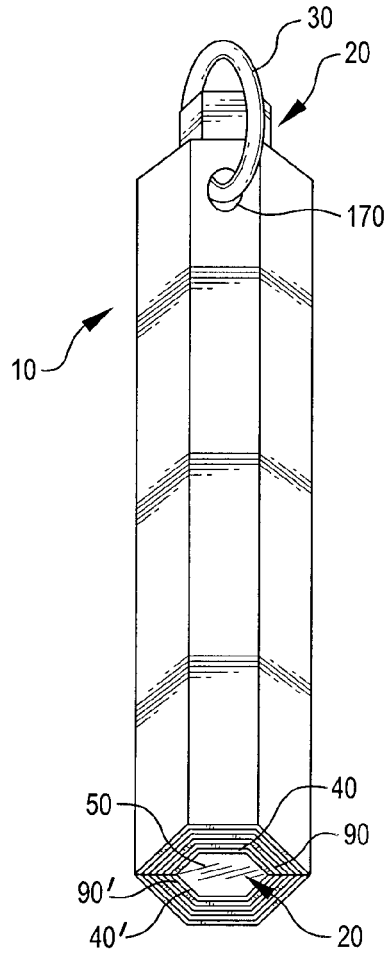
FIG. 2 shows a perspective view of an embodiment of an assembled hex wrench device.

A hex wrench device 10, as shown in FIGS. 1 and 2, is provided. The inventive hex wrench device 10 comprises at least one longitudinal member 20 and a plurality of complementary wrench sleeve pairs 40 and 40', 90 and 90'. The hex wrench device 10 is capable of forming a series of hex keys with incrementally increasing surface areas by way of magnetic force, and adjustment of a particular hex key to a desired size entails either magnetically attaching or magnetically disassembling the appropriate wrench sleeves 40 and 40', 90 and 90' to or from longitudinal member 20.

Magnetic longitudinal member 20 resembles any hex wrench known in the art and comprises a longitudinal member head 50 with a hexagonal configuration at each end 120, 140 of longitudinal member 20. In the embodiment shown in FIGS. 1 and 2, head 50 has six sides 80 and is used for driving a screw, a bolt, and the like having a hexagonally shaped receiving socket. In this embodiment, head 50 of longitudinal member 20 fits or corresponds to screws, bolts, and the like having a receiving socket of 5/64", although other suitable sizes of head 50 may be used. Body 60 of longitudinal member 20 comprises at least six longitudinal surfaces 70. Each longitudinal surface 70 corresponds to one side 80 of the hexagonally shaped head 50. Body 60 is provided with at least one aperture 100 located proximal to a non-operational end 120 of longitudinal member 20. In the embodiment as shown in FIGS. 1 and 2, longitudinal member 20 is about six inches in length and is provided with two apertures 100, each aperture having a diameter about 0.05 inches and being located about 1/4" from end 120.

The hex wrench device 10 comprises at least one pair of complementary wrench sleeves 40 and 40' and the wrench sleeve pairs 40 and 40', 90 and 90' have substantially the same length as longitudinal member 20. In the embodiment as shown in FIGS. 1 and 2, hex wrench device 10 is provided with twelve wrench sleeves, or six pairs of complementary wrench sleeves. In the embodiment as shown in FIGS. 1 and 2, the thickness of each wrench sleeve 40 and 40', 90 and 90' is about 1/32" and the length of each wrench sleeve 40 and 40', 90 and 90' is about 5 and 3/4 inches.

Each wrench sleeve of a pair of complementary wrench sleeves is provided with at least one longitudinal surface 150. In other words, each pair of complementary wrench sleeves 40 and 40', 90 and 90' have six longitudinal surfaces 150 in total. In one embodiment, the first wrench sleeve of a pair of complementary wrench sleeves has one longitudinal surface 150 and the second wrench sleeve of the pair has five longitudinal surfaces 150. In another embodiment, the first wrench sleeve of a pair of complementary wrench sleeves has two longitudinal surfaces 150 and the second wrench sleeve of the pair has four longitudinal surfaces 150. In yet another embodiment, as shown in FIGS. 1 and 2, the first wrench sleeve of a pair of complementary wrench sleeves has three longitudinal surfaces 150 and the second wrench sleeve of the pair also has three longitudinal surfaces 150.

As shown in FIG. 2, when assembled, the interior of each longitudinal surface 150 of a pair of complementary wrench sleeves 40 and 40', 90 and 90' is magnetically and longitudinally connected to body 60 of longitudinal member 20. In this embodiment, when assembled with the proper complementary wrench sleeves, the hex wrench device 10 may have hex keys that fit or correspond to screws or bolts having receiving socket sizes of 3/32", 1/8", 5/32", 3/16", 7/32" and 1/4". Hex wrench device 10 weighs about 10 ounces when all wrench sleeves are connected thereto. Further, each wrench sleeve 40 and 40', 90 and 90' is provided with at least one aperture 170 located proximal to non-operational ends 180 of wrench sleeves 40 and 40', 90 and 90'.

In one embodiment of the hex wrench device 10, longitudinal member 20 provides a magnetic force and the plurality of wrench sleeves 40 and 40', 90 and 90' is made of a material having a high permeability, which is the degree of magnetization of a material that responds linearly to an applied magnetic field. In this embodiment, longitudinal member 20 is constructed of a material capable of providing magnetic force or comprises at least one magnet or electromagnet located in the interior of its body 60, substantially extending along the length of the longitudinal member's body 60. In another embodiment, longitudinal member 20 comprises a plurality of magnets or electromagnets located in the interior of its body. Body 60 of magnetic longitudinal member 20 may be constructed of chrome vanadium steel, and the like. The magnet may include, but are not limited to, neodymium magnet, samarium-cobalt magnet, ceramic magnet, alnico magnet, injection molded/bonded magnet, ferrite magnet, and plastic magnets. In this embodiment, the wrench sleeves 40 and 40', 90 and 90' are made of iron or steel. In one embodiment, wrench sleeves 40 and 40', 90 and 90' is constructed of chrome vanadium steel.

In another embodiment of the hex wrench device 10, longitudinal member 20 is not a magnet and is not provided with a magnet or an electromagnet. Rather, longitudinal member 20 is made of iron or steel, such as chrome vanadium steel, and the plurality of wrench sleeves comprises at least one magnet or made of materials capable of providing magnetic force.

As shown in FIGS. 1 and 2, hex wrench device 10 is provided with a carrier 30, which movably holds longitudinal member 20 and the plurality of wrench sleeves 40 and 40', 90 and 90'. Carrier 30 resembles a key ring and may have various configurations including, but not limited to, circular, oval, triangular, quadrilateral, hexagonal, and the like. In the embodiment shown in FIGS. 1 and 2, carrier 30 is circular and its diameter is about one inch. The surface area of the perimeter of carrier 30 is smaller than the areas of apertures 100 and 170, so that longitudinal member 20 and wrench sleeves 40 and 40', 90 and 90' can slide freely around carrier 30. Carrier 30 passes through aperture 100 of longitudinal member 20 and apertures 170 of the plurality of wrench sleeves 40 and 40', 90 and 90', and can be continuous and close-ended. Alternatively, carrier 30 can be provided with an opening means, whereby longitudinal member 20 and the plurality of wrench sleeves 40 and 40', 90 and 90' can be removed from carrier 30, while additional wrench sleeves can be added to carrier 30. Carrier 30 can be constructed of any metal, such as chrome nickel alloy, and the like.

In operation, longitudinal member 20 operates as a hex key and constitutes the smallest-sized hex key of the inventive hex wrench device 10. The plurality of complementary wrench sleeve pairs 40 and 40', 90 and 90' are capable of forming a series of hex keys with incrementally increasing surface areas when the complementary wrench sleeve pairs 40 and 40', 90 and 90' are assembled. When assembled, as shown in FIG. 2, at least one wrench sleeve 40, 90 is magnetically and longitudinally connected to longitudinal member 20. When two complementary wrench sleeves 40 and 40' are magnetically and longitudinally connected to longitudinal member 20, a hex key having a larger surface area than that of longitudinal member 20 is formed. In this embodiment, complementary wrench sleeves 90 and 90' have larger total surface areas than that of complementary wrench sleeves 40 and 40'. When complementary wrench sleeves 90 and 90' are magnetically and longitudinally connected to complementary wrench sleeves 40 and 40', which in turn are magnetically and longitudinally connected to longitudinal member 20, another hex key having a larger surface area than that of the magnetically and longitudinally connected complementary wrench sleeves 40 and 40' and longitudinal member 20 is formed.

While certain embodiments of the present invention have been described, it will be understood that various changes could be made in the above constructions without departing from the scope of the invention. It is intended that all matter contained in the above description or shown in the accompanying drawings shall be interpreted as illustrative and not in a limiting sense.

I claim:

1. A hex wrench device, comprising:

(a) at least one longitudinal member; and (b) at least one pair of complementary wrench sleeves which can be magnetically and longitudinally connected to the longitudinal member, wherein a hex key having a larger total surface area than that of the longitudinal member is formed when the complementary wrench sleeves are magnetically and longitudinally connected to the longitudinal member.

2. The hex wrench of claim 1, wherein the longitudinal member comprises:

(a) a head having a hexagonal configuration;

(b) six longitudinal surfaces, wherein each longitudinal surface corresponds to a side of the hexagonal head; and (c) at least one aperture located proximal to a non-operational end of the longitudinal member.

3. The hex wrench of claim 1, wherein each wrench sleeve of the at least one pair of complementary wrench sleeves comprises at least one longitudinal surface and at least one aperture located proximal to a non-operational end of the wrench sleeve.

4. The hex wrench of claim 3, wherein a first wrench sleeve of the at least one pair of complementary wrench sleeves comprises one longitudinal surface, and wherein the second wrench sleeve of the pair comprises five longitudinal surfaces.

5. The hex wrench of claim 3, wherein a first wrench sleeve of the at least one pair of complementary wrench sleeves comprises two longitudinal surfaces, and wherein the second wrench sleeve of the pair comprises four longitudinal surfaces.

6. The hex wrench of claim 3, wherein a first wrench sleeve of the at least one pair of complementary wrench sleeves comprises three longitudinal surfaces, and wherein the second wrench sleeve of the pair comprises three longitudinal surfaces.

7. The hex wrench of claim 1, wherein the longitudinal member is constructed of a material capable of providing magnetic force and the wrench sleeves are made of iron or steel.

8. The hex wrench of claim 1, wherein the longitudinal member comprises at least one magnet or electromagnet located in an interior of its body, and wherein the wrench sleeves are made of iron or steel.

9. The hex wrench of claim 8, wherein the length of the at least one magnet or electromagnet substantially equals the length of the longitudinal member's body.

10. The hex wrench of claim 8, wherein the magnet is selected from the group consisting of: neodymium magnets, samarium-cobalt magnets, ceramic magnets, alnico magnets, injection molded/bonded magnets, ferrite magnets, and plastic magnets.

11. The hex wrench of claim 1, wherein the longitudinal member is made of iron or steel and the wrench sleeves are constructed of materials capable of providing magnetic force.

12. The hex wrench of claim 1, wherein the longitudinal member is made of iron or steel and the wrench sleeves comprises at least one magnet or electromagnet located in the wrench sleeves' interior.

13. The hex wrench of claim 1, wherein the hex wrench device further comprises a carrier that carries the at least one longitudinal member and the at least one pair of complementary wrench sleeves.

14. The hex wrench of claim 13, wherein the configuration of the carrier is selected from the group consisting of: circular, oval, triangular, quadrilateral, and hexagonal.

15. A hex wrench device, comprising:

(a) at least one longitudinal member; and (b) six pairs of complementary wrench sleeves which can be magnetically and longitudinally connected to the longitudinal member, wherein a series of hex keys with incrementally increasing surface areas are formed when the complementary wrench sleeve pairs are assembled magnetically to the longitudinal member.

16. The hex wrench of claim 15, wherein the longitudinal member comprises at least one magnet or an electromagnet located in an interior of its body, and wherein the wrench sleeves are made of iron or steel.

17. The hex wrench of claim 15, wherein the longitudinal member is made of iron or steel and the wrench sleeves comprises a material capable of providing magnetic force.

18. A hex wrench device, comprising:

(a) at least one longitudinal member;

(b) at least one pair of complementary wrench sleeves which can be magnetically and longitudinally connected to the longitudinal member; and (c) a carrier that carries the at least one longitudinal member and the at least one pair of complementary wrench sleeves, wherein a hex key having a larger total surface area than that of the longitudinal member is formed when the complementary wrench sleeves are magnetically and longitudinally connected to the longitudinal member.

19. The hex wrench of claim 18, wherein the longitudinal member comprises at least one magnet or an electromagnet located in an interior of its body, and wherein the wrench sleeves are made of iron or steel.

20. The hex wrench of claim 18, wherein the longitudinal member is made of iron or steel and the wrench sleeves comprises a material capable of providing magnetic force.

* * * * *